United States Patent [19]

Nunn et al.

[11] Patent Number: 4,988,451

[45] Date of Patent: Jan. 29, 1991

[54] STABILIZATION OF PARTICLES CONTAINING QUATERNARY AMMONIUM BLEACH PRECURSORS

[75] Inventors: Charles C. Nunn, Rutherford, N.J.; William J. Worley, Loveland, Ohio

[73] Assignee: Lever Brothers Company, Division of Conopco, Inc., New York, N.Y.

[21] Appl. No.: 366,121

[22] Filed: Jun. 14, 1989

[51] Int. Cl.[5] ..... C11D 3/375; C11D 7/54

[52] U.S. Cl. ..... 252/95; 252/186.1; 252/186.21; 252/186.38; 252/186.41; 544/139; 544/168; 546/222; 546/292; 546/301; 558/263; 558/271

[58] Field of Search ..... 252/95, 99, 186.38, 252/186.39, 186.4, 186.41, 186.42; 558/276, 271, 263, 270, 275; 544/139, 168, 171; 546/210, 222, 232, 238, 242, 247, 248, 291, 292

[56] References Cited

U.S. PATENT DOCUMENTS

| | | | |
|---|---|---|---|
| 3,833,506 | 9/1974 | Fries et al. | 252/99 |
| 3,925,234 | 12/1975 | Hachmann et al. | 252/186 |
| 4,009,113 | 2/1977 | Green et al. | 252/95 |
| 4,087,369 | 5/1978 | Wevers | 252/102 |
| 4,111,826 | 9/1978 | Leigh et al. | 252/89 |
| 4,372,868 | 2/1983 | Saran et al. | 252/102 |
| 4,399,049 | 8/1983 | Gray et al. | 252/91 |
| 4,444,674 | 4/1984 | Gray | 252/95 |
| 4,486,327 | 12/1984 | Murphy et al. | 252/94 |
| 4,678,594 | 7/1987 | Parfomak et al. | 252/186.31 |
| 4,751,015 | 6/1988 | Humphreys et al. | 252/99 |

FOREIGN PATENT DOCUMENTS 299599 10/1988 European Pat. Off. .

*Primary Examiner*—Paul Lieberman
*Assistant Examiner*—Alexander G. Ghyka
*Attorney, Agent, or Firm*—Milton L. Honig

[57] ABSTRACT

A particulate additive is reported which is an intimately blended mixture of a precursor, a stabilizing agent and a dispersing agent. The precursor is a quaternized ammonium or phosphonium substituted carbonic acid ester. A $C_4$ or higher organic acid having at least one carboxylic group, such a lauric acid, or a solid inorganic acid, such as potassium bisulfate, is required as the stabilizing agent. Various alkoxylated fatty alcohols, fatty acids or alkylated phenols are utilized as the dispersing agent. These particulate additives are employed as adjuncts in bleaching-detergent compositions.

18 Claims, No Drawings

STABILIZATION OF PARTICLES CONTAINING QUATERNARY AMMONIUM BLEACH PRECURSORS

BACKGROUND OF THE INVENTION

1. Field of the Invention

The present invention relates to bleach promoting particles suitable for incorporation into detergent formulations.

2. The Related Art

Hydrogen peroxide releasing compounds have long been known for their capability of removing stains from fabrics. Among the most commonly employed materials for this purpose is sodium perborate, either in the tetrahydrate or monohydrate form.

When laundering fabrics at or near the boil temperatures of 85° to 100° C., perborate and similar persalt materials perform well. Over the years, the temperatures at which consumers launder have however declined. Today it is common to conduct the washing process below 60° C. Under such conditions, the performance of perborate and like materials is poor. To overcome the low temperature problem, hydrogen peroxide releasing agents alternately known as bleach precursors, promoters or activators have been used in conjunction with the persalts.

A recently issued patent, U.S. Pat. No. 4,751,015 (Humphreys et al.) reported an exceptionally effective family of bleach precursor compounds identified as quaternary ammonium or phosphonium substituted carbonic acid esters. A number of problems have been noted with these compounds. Work on the 2-(N,N,N-trimethyl-ammonium)ethyl sodium 4-sulfophenyl carbonate salt (CSPC) has indicated that this compound is very hydrolytically unstable. The hydrolysis rate of CSPC approaches 100%. This rate is measured by placing $7.46 \times 10^{-3}$ mols/liter of the precursor into a 0.4% w/v detergent solution with continuous stirring at 20° C., in the absence of any peroxy bleach component, under constant pH adjustment to 9.7 for 60 minutes prior to determining the amount of precursor hydrolyzed.

Other precursors have also been described in the literature. For instance, U.S. Pat. No. 4,087,369 (Wevers) reports improving the storage stability of a certain class of perbleach activator (precursor) by agglomeration with an agent that is chemically inert relative to the activator. The class of activators disclosed therein are characterized by a rate of hydrolysis ranging from about 5 to 45% as measured by the aforedescribed hydrolytic stability test procedure. Included among these reasonably stable activators are tetraacetyl ethylene diamine (TAED) and sodium p-benzoyloxybenzene sulfonate (SBOBS). Agglomerating agents suitable for use therein are generically described as having melting points in the range from about 25°-100° C. Specific classes include ethoxylated $C_{10}$-$C_{18}$ carboxylic acids, ethoxylated $C_{10}$-$C_{24}$ alcohols, $C_{10}$-$C_{15}$ amides, polyethylene glycols, ethoxylated $C_8$-$C_{18}$ alkyl phenols, $C_{12}$-$C_{30}$ fatty acids and $C_{16}$-$C_{30}$ fatty alcohols.

U.S. Pat. No. 4,009,113 (Green et al.) discloses a slightly different manner of protecting precursor compounds of the type listed by Wevers. Finely divided particulate precursor compound is evenly mixed with an inert carrier material. Around the resultant particle is placed an outer protective, non-deliquescent coherent layer of polyvinyl alcohol, polyacrylamide, starch, water-soluble cellulose ether or water-soluble gum. Among the suitable inert carrier materials are listed lauric acid, sodium dodecyl hydrogen phthalate, sodium dodecyl hydrogen succinate, sodium lauryl sulphate or liquid paraffin.

U.S. Pat. No. 3,925,234 (Hachmann et al.) focuses upon stabilizing bleaching assistants of the N-acyl and O-acyl compound variety. Chief among these compounds is tetraacetyl glycoluril, a material known in the art as having a 60% rate of hydrolysis. Stabilization is accomplished by surrounding the bleaching assistant with an other coating that is a mixture of $C_{12}$-$C_{24}$ fatty acid with fatty alcohols (or water-soluble ethoxylated derivatives thereof) in a weight proportion of 10:1 to 2:1.

U.S. Pat. No. 3,833,506 (Fries et al.) is concerned with the same bleaching assistants as those of Hachmann et al. Stabilization is here accomplished by forming an intimate mixture between 10-70% of a bleaching assistant and 30-90% of a mixture of fatty acids and polyethylene glycol.

U.S. Pat. No. 4,678,594 (Parfomak et al.) encapsulates a mixture of sodium nonanoyloxybenzene sulfonate (SNOBS) and sodium perborate in a matrix of nonionic ethoxylated alcohol surfactant. Use of ethoxylated nonionic surfactant as a storage stability and water-dispersibility aid for peroxy acid bleach precursors is also reported in U.S. Pat. No. 4,399,049 (Gray et al.).

U.S. Pat. No. 4,486,327 (Murphy et al.) focuses upon branched alpha-substituted derivatives of $C_6$-$C_{18}$ carboxylic acid ester type activators. Better storage stability of the activator is achieved by evenly distributing therewith a binder material which may be selected from nonionic surfactants, polyethylene glycols, anionic surfactants, film-forming polymers, fatty acids and mixtures thereof.

Other patents directed toward solving storage stability and/or dispersibility problems for bleach precursors include U.S. Pat. No. 4,444,674 (Gray), U.S. Pat. No. 4,111,826 (Leigh et al.), and U.S. Pat. No. 4,372,868 (Saran et al.).

None of the aforementioned art has focused upon solving the substantially greater hydrolytic instability problem presented by the quaternary ammonium carbonic acid precursors, such as CSPC, described by Humphreys et al. These compounds have unique chemical breakdown products and mechanisms that necessitate unique solutions. Not only must the proper stabilization agent be provided but dispersibility in the wash liquor must not thereby be hindered.

Accordingly, it is an object of the present invention to provide bleach precursor particles that have improved hydrolytic stability and thereby prolonged storage capability.

It is another object of the present invention to provide bleach precursor particles that are not only storage stable but also exhibit excellent water dispersibility in a wash medium.

A still further object of the present invention is to provide a detergent composition containing the bleach activator particle which will deliver a high level of bleach performance against stains.

These and other objects of the invention will become more apparent through the detailed description provided below.

SUMMARY OF THE INVENTION

A particulate detergent composition additive is provided which is an intimately blended mixture comprising:

(i) from 30 to 95% of a precursor compound having the formula:

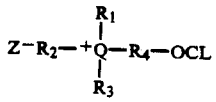

(I)

wherein:

$R_1$, $R_2$ and $R_3$ are each a radical selected from the group consisting of alkyl, alkenyl, alkynyl, cycloalkyl, cycloalkenyl, alkaryl, aryl, phenyl, hydroxyalkyl, polyoxyalkylene, and $R_4OCOL$;

or two or more of $R_1$, $R_2$, and $R_3$ together form an alkyl substituted or unsubstituted nitrogen-containing heterocyclic ring system;

or at least one of $R_1$, $R_2$, and $R_3$ is attached to $R_4$ to form an alkyl substituted or unsubstituted nitrogen-containing heterocyclic ring system;

$R_4$ is selected from a bridging group consisting of alkylene, cycloalkylene, alkylenephenylene, phenylene, arylene, and polyalkoxylene; and wherein the bridging group can be unsubstituted or substituted with $C_1$–$C_{20}$ atoms selected from alkyl, alkenyl, benzyl, phenyl and aryl radicals;

$Z^-$ is a monovalent or multivalent anion leading to charge neutrality when combined with $Q^+$ in the appropriate ratio and wherein $Z^-$ is sufficiently oxidatively stable not to interfere significantly with bleaching by a peroxy carbonic acid;

Q is nitrogen or phosphorous; and

L is selected from the group consisting of

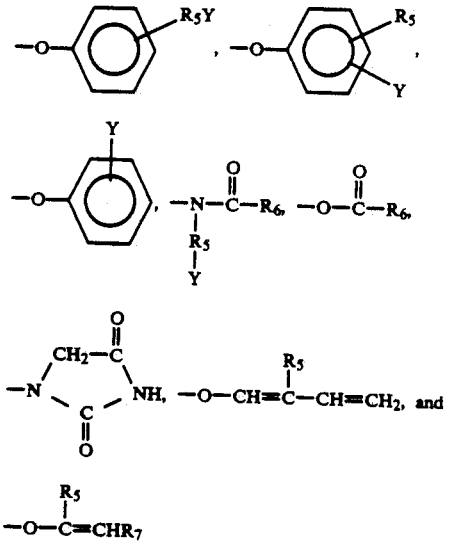

wherein $R_5$ and $R_6$ are a $C_1$–$C_{12}$ alkyl group, $R_7$ is H or $R_5$, and Y is selected from the group consisting of H, $-SO^{-3}M^+$, $-COO^-M^+$, $-SO_{-4}M^+$, $-N^+(R_5)_3X^-$, $NO_2$, OH, and O $\leftarrow N(R_5)_2$ and mixtures thereof; $M^+$ is a cation which provides solubility to the precursor, and $X^-$ is an anion which provides solubility to the precursor;

(ii) a stabilizing agent for said precursor present in an effective amount to restrain hydrolysis, said stabilizing agent being selected from the group consisting of solid inorganic acids and $C_4$ or higher organic acids having at least one carboxylic group; and (iii) a dispersing agent which is a water-soluble ethoxylated material present in an effective amount to promote dispersion of the particulate in an aqueous medium, said agent being selected from the group consisting of alkoxylated fatty alcohols, alkoxylated fatty acids, alkoxylated alkylphenols, polypropoxylated-polyethoxylated copolymers and mixtures thereof.

Additionally, there are provided detergent compositions that include the particulate additive having peroxy bleach precursor which compositions comprise:

(i) from 1 to 60% of a peroxygen compound capable of yielding hydrogen peroxide in an aqueous solution;

(ii) from 0.1 to 40% of the particulate additive having bleach precursor;

(iii) from 0 to 50% of a surfactant; and (iv) from 0 to 70% of a detergent builder.

DETAILED DESCRIPTION OF THE INVENTION

Highly hydrolytically unstable bleach precursors such as those represented by formula (I) have been rendered stable against hydrolysis by incorporation of a carboxylic acid containing stabilizing agent. A further necessary component is a dispersing agent which promotes rapid distribution of precursor in an aqueous wash medium. A combination of both the stabilizing and dispersing agents are necessary for proper functioning of the precursor delivery system.

The precursor of this invention will be selected from a compound having the general formula:

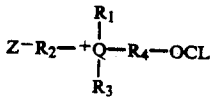

(I)

Leaving groups (L) effective for the present invention will induce rapid formation of a peroxy carbonic acid in the presence of hydrogen peroxide released from a peroxygen source under mild conditions, e.g., in detergent solution during laundering of clothes. Generally, L must be of an electron attracting structure which promotes successful nucleophilic attack by the perhydroxide anion.

Illustrative of the leaving structures L are those selected from the group consisting of:

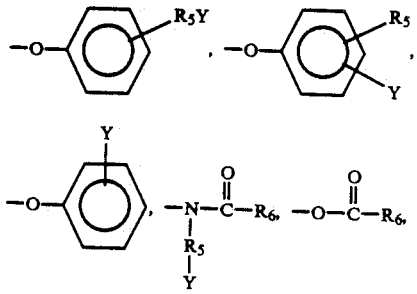

-continued

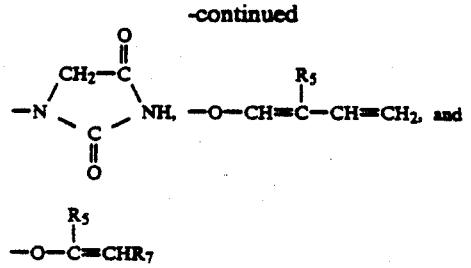

wherein $R_5$ and $R_6$ are a $C_1$–$C_{12}$ alkyl group, $R_7$ is H or $R_5$, and Y is H or a water solubilizing group. Preferred solubilizing groups are $-SO^-{}_3M^+$, $-COO^-M^+$, $-SO_4M^+$, $-N^+(R_6)_3X-$, $NO_2$, OH, and O $\leftarrow N(R_6)_2$ and mixtures thereof;

wherein $M^+$ is a hydrogen, alkali metal, ammonium or alkyl or hydroxyalkyl substituted ammonium cation. $X^-$ is a halide, hydroxide, phosphate, sulfate, methyl sulfate or acetate anion.

Most preferred of the leaving groups is the phenol sulfonate type. Especially preferred is the 4-sulphophenyl group. Sodium, potassium and ammonium cations are the preferred counterions to the sulphophenol structures.

Although phosphonium groups where Q is phosphorous is within the scope of this invention, for economic reasons it is most preferred that Q be nitrogen. Furthermore, the precursor and respective peracid derivative compounds should preferably contain a quaternary ammonium carbon surrounded by $R_1$, $R_2$ and $R_3$ each the same or different and having $C_1$–$C_{20}$ atom radicals selected from the group consisting of alkyl, alkylaryl, benzyl, hydroxyalkyl, heterocyclic rings containing the quaternary nitrogen groups where $R_1$ and $R_4$ or $R_1$ and $R_2$ are joined together, and mixtures of groups thereof.

In particular, it is desirable that $R_1$ be a short-chain $C_1$–$C_4$ alkyl radical, preferably methyl, while $R_2$ and $R_3$ be a longer chain $C_7$–$C_{20}$ alkyl or alkylaryl, such as stearyl, lauryl, or benzyl group. With regard to the $R_4$ bridge between the quaternary nitrogen and carbonate groups, it is desirable that $R_4$ be a group selected from $C_2$–$C_{20}$ alkylene, $C_6$–$C_{12}$ phenylene, $C_5$–$C_{20}$ cycloalkylene, and $C_8$–$C_{20}$ alkylenephenylene groups. Preferably, the alkylene groups should have 2 carbon atoms. Further, the bridging group can be unsubstituted or substituted with $C_1$–$C_{20}$ alkyl, alkenyl, benzyl, phenyl and aryl radicals.

Within the context of this invention, there may be compounds having the general structure (I) where $R_1$ and $R_4$ together or $R_1$ and $R_2$ together form an alkyl substituted or unsubstituted nitrogen-containing heterocyclic ring system. Representative of these systems are rings defining pyridine, morpholine, pyrrolidine, piperidine and piperazine.

The preferred precursor compounds are exemplified by structure II.

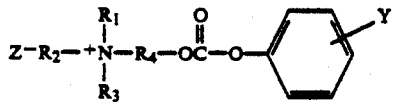

(II)

A critical second component of the particulate additive is a stabilizing agent which is either a solid inorganic acid or a $C_4$ or higher organic acid having having at least one carboxylic group. Suitable organic acid type stabilizing agents include $C_4$–$C_{22}$ monocarboxylic acids, $C_4$–$C_{22}$ dicarboxylic acids, and $C_4$–$C_{22}$ tri- or higher polycarboxylic acids. Preferred among the monocarboxylic acids are $C_{10}$–$C_{22}$ fatty acids represented by lauric, myristic, palmitic, stearic and isostearic acids. Other monocarboxylic acids of interest are benzoic, benzylic, ethylhexanoic, n-octanoic and similar acids. Dicarboxylic acids useful in the present invention are phthalic, terephthalic, isophthalic, tartaric, carboxymethyloxy succinic, fumaric, maleic, malic, adipic, succinic, oxydisuccinic and dodecanedioic acids. Tri- and higher polycarboxylic acids useful herein include citric acid, polyacrylic acid, polymethacrylic acid and polyacrylic/maleic acid polymers Suitable solid inorganic acids include potassium or sodium bisulfate, potassium or sodium bisulfite, potassium or sodium hydrogen phosphate and mixtures thereof.

Stabilizing agent may be incorporated in amounts from at least 5% up to 50%. Preferably the stabilizing agent will range in amount between 5% and 30%, optimally around 10%.

A critical third component of the particulate additive is a dispersing agent. Representative of this type material are alkoxylated $C_{10}$–$C_{22}$ fatty alcohols, alkoxylated $C_{10}$–$C_{22}$ fatty acids, alkoxylated $C_6$–$C_{22}$ alkyl phenols, polypropoxylatedpolyethoxylated copolymers and mixtures thereof. Normally, the dispersing agent will be a condensation product of ethylene oxide and/or propylene oxide with a primary or secondary $C_8$–$C_{22}$ aliphatic alcohol or carboxylic acid. To ensure water solubility, there will be required anywhere from about 10 to about 100 mols of ethylene oxide and/or propylene oxide per mole of alcohol or carboxylic acid. Preferably, the amount of alkoxide per mole hydrophobe will range from about 20 to about 80. Particularly useful dispersing agents are Brij 76®, Brij 721® and Brij 700® chemically identified as polyoxyethylene 10 stearyl ether, polyoxyethylene 21 stearyl ether and polyoxyethylene 100 stearyl ether, respectively, sold by ICI Americas, Inc. Other useful dispersing agents include Plurafac A38® (a polyethoxylated straight chain alcohol sold by BASF Wyandotte Corporation) and Tergitol 15-S-20® (a $C_{11}$–$C_{15}$ secondary alcohol having 20 mols ethoxylation sold by Union Carbide Corp.).

Dispersing agent may be incorporated in amounts from about 5% to about 50%. Preferably the dispersing agent will range in amount between about 10% to about 20%.

Generally, the ratio of stabilizing agent to dispersing agent will range from about 5:1 to 1:5. When a combination of water-insoluble stabilizing agent is employed with the dispersing agent, the relative ratios of the two materials will desirably range from about 1:1 to about 1:3, preferably between about 1:1 to 1:2. Much higher ratios may be employed when the stabilizing agent is water soluble. Under these circumstances, the ratio of stabilizing to dispersing agent may range from about 3:1 to 1:3, preferably between about 2:1 to 1:2.

The foregoing particulate additives containing precursors may be incorporated into detergent bleach compositions which require as an essential component a peroxygen bleaching compound capable of yielding hydrogen peroxide in an aqueous solution.

Hydrogen peroxide sources are well known in the art. They include the alkali metal peroxides, organic peroxide bleaching compounds such as urea peroxide, and inorganic persalt bleaching compounds, such as the alkali metal perborates, percarbonates, perphosphates and persulfates. Mixtures of two or more such compounds may also be suitable. Particularly preferred are sodium perborate tetrahydrate and, especially, sodium perborate monohydrate. Sodium perborate monohydrate is preferred because it has excellent storage stability while also dissolving very quickly in aqueous bleaching solutions. Rapid dissolution is believed to permit formation of higher levels of percarboxylic acid which would enhance surface bleaching performance.

A detergent formulation containing a bleach system consisting of an active oxygen releasing material and a novel compound of the invention will usually also contain surface-active materials, detergency builders and other known ingredients of such formulations.

The surface-active material may be naturally derived, such as soap, or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch. The total level of the surface-active material may range up to 50% by weight, preferably being from about 1% to 40% by weight of the composition, most preferably 4 to 25%.

Synthetic anionic surface-actives are usually water-soluble alkali metal salts of organic sulphates and sulphonates having alkyl radicals containing from about 8 to about 22 carbon atoms, the term alkyl being used to include the alkyl portion of higher aryl radicals.

Examples of suitable synthetic anionic detergent compounds are sodium and ammonium alkyl sulphates, especially those obtained by sulphating higher ($C_8$–$C_{18}$) alcohols produced for example from tallow or coconut oil; sodium and ammonium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow coconut oil and synthetic alcohols derived from petroleum; sodium coconut oil fatty acid monoglyceride sulphates and sulphonates; sodium and ammonium salts of sulphuric acid esters of higher ($C_9$–$C_{18}$) fatty alcohol-alkylene oxide, particularly ethylene oxide reaction products; the reaction products of fatty acids such as coconut fatty acids esterified with isethionic acid and neutralized with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $C_{12}$ and then hydrolyzing with a base to produce a random sulphonate; sodium and ammonium $C_7$–$C_{12}$ dialkyl sulfosuccinates; and olefinic sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkylbenzene sulphonates; sodium ($C_{16}$–$C_{18}$) alkyl sulphates and sodium $C_{16}$–$C_{18}$) alkyl ether sulphates.

Examples of suitable nonionic surface-active compounds which may be used, preferably together with the anionic surface active compounds, include in particular the reaction products of alkylene oxides, usually ethylene oxide, with alkyl ($C_6$–$C_{22}$) phenols, generally 5–25 EO, i.e. 5–25 units of ethylene oxides per molecule; the condensation products of aliphatic ($C_{8-C18}$) primary or secondary linear or branched alcohols with ethylene oxide, generally 6–30 EO, and products made by condensation of ethylene oxide with the reaction products of propylene oxide and ethylene diamine. Other so-called nonionic surface-actives include alkyl polyglycosides, long chain tertiary amine oxides, long chain tertiary phosphine oxides and dialkyl sulphoxides.

Amounts of amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

As stated above, soaps may also be incorporated into the compositions of the invention, preferably at a level of less than 30% by weight. They are particularly useful at low levels in binary (soap/anionic) or ternary mixtures together with nonionic or mixed synthetic anionic and nonionic compounds. Soaps which are used are preferably the sodium, or less desirably potassium, salts of saturated or unsaturated $C_{10}$–$C_{24}$ fatty acids or mixtures thereof. The amount of such soaps can be varied between about 0.5% and about 25% by weight, with lower amounts of about 0.5% to about 5% being generally sufficient for lather control. Amounts of soap between about 2% and about 20%, especially between about 5% and about 15%, are used to give a beneficial effect on detergency. This is particularly valuable in compositions used in hard water when the soap acts as a supplementary builder.

The detergent compositions of the invention will normally also contain a detergency builder. Builder materials may be selected from (1) calcium sequestrant materials, (2) precipitating materials, (3) calcium ion-exchange materials and (4) mixtures thereof.

Examples of calcium sequestrant builder materials include alkali metal polyphosphates, such as sodium tripolyphosphate; nitrilotriacetic acid and its water-soluble salts; the alkali metal salts of carboxymethyloxy succinic acid, ethylene diamine tetraacetic acid, oxydisuccinic acid, mellitic acid, benzene polycarboxylic acids, citric acid; and polyacetalcarboxylates as disclosed in U.S. Pat. Nos. 4,144,225 and 4,146,495.

Examples of precipitating builder materials include sodium orthophosphate, sodium carbonate and long-chained fatty acid soaps.

Examples of calcium ion-exchange builder materials include the various types of water-insoluble crystalline or amorphous aluminosilicates, of which zeolites are the best known representatives.

In particular, the compositions of the invention may contain any one of the organic or inorganic builder materials, such as sodium or potassium tripolyphosphate, sodium or potassium pyrophosphate, sodium or potassium orthophosphate, sodium carbonate, the sodium salt of nitrilotriacetic acid, sodium citrate, carboxymethylmalonate, carboxymethyloxysuccinate and the water-insoluble crystalline or amorphous aluminosilicate builder materials, or mixtures thereof.

These builder materials may be present at a level of, for example, from 5 to 80% by weight, preferably from 10 to 60% by weight.

When the peroxygen compound and particulate additive with bleach precursor are dispersed in water, a peroxy acid is generated which should deliver from about 0.1 to about 50 ppm active oxygen per liter of water; preferably oxygen delivery should range from 2 to 15 ppm. Surfactant should be present in the wash water from about 0.005 to 1.0 grams per liter, preferably from 0.15 to 0.20 grams per liter. When present, the builder amount will range from about 0.1 to 3.0 grams per liter.

Apart from the components already mentioned, the detergent compositions of the invention can contain any of the conventional additives in the amounts in which such materials are normally employed in detergent compositions. Examples of these additives include lather boosters such as alkanolamides, particularly the monoethanolamides derived from palmkernel fatty acids and coconut fatty acids, lather depressants such as alkyl phosphates and silicones, anti-redeposition agents such as sodium carboxymethylcellulose and alkyl or substituted alkylcellulose ethers, other stabilizers such as ethylene diamine tetraacetic acid, fabric softening agents, inorganic salts such as sodium sulphate, and, usually present in very small amounts, fluorescent agents, perfumes, enzymes such as proteases, cellulases, lipases and amylases, germicides and colorants.

The bleach precursors and their peroxycarbonic acid derivatives described herein are useful in a variety of cleaning products. These include laundry detergents, laundry bleaches, hard surface cleaners, toilet bowl cleaners, automatic dishwashing compositions and even denture cleaners. Precursors of the present invention can be introduced in a variety of product forms including powders, on sheets or other substrates, in pouches, in tablets or in non-aqueous liquids such as liquid nonionic detergents.

The following examples will more fully illustrate the embodiments of this invention. All parts, percentages and proportions referred to herein and in the appended claims are by weight unless otherwise illustrated.

EXAMPLE 1

DETAILS OF EXPERIMENTAL METHODS

Preparation of Particulate Additive

Noodle-like particulate additives were made in the laboratory by the following procedure. Appropriate weighed amounts of CSPC, stabilizing and dispersing agents as well as minor components were placed into the bowl of a Kitchen-Aid ® mixer. This mixture was then heated above the melting point of the dispersing agents, typically to 60° C., and the mixture thoroughly blended in the Kitchen-Aid ® mixer. The mixture was then passed through a conventional domestic meat grinder (Moulinex model 303). Heating tape was placed around the grinder to prevent, as necessary, the material from solidifying inside the grinder. As the mixture exited the meat grinder, it passed through an extrusion die consisting of holes about 1.5 mm in diameter, and hardened into well formed noodles. These noodles were passed through a home-made marumerizer which chopped them into pieces on the order of a 0.5–3 mm in length. Fines were removed by shaking in a #16 sieve (mesh size 1.2 mm). The particulate additives so obtained were used in the storage studies reported beloW.

The CSPC used was material made according to the phosgenation process described in U.S. Pat. No. 4,751,015. It typically contained about 75% of CSPC and about 25% of NaCl. Because various batches of CSPC contained slightly differing levels of NaCl, the particulate additive levels used in various storage and bleaching experiments were adjusted so as to account for the amount of CSPC actually present. In all the tables presented herein, except where otherwise noted, the term "% Precursor" refers to the level of precursor raw material actually used on an as-is basis.

Other bleach precursors were studied in order to show the special behavior of CSPC as distinguished from the known art wherein various combinations of precursors and binders are described. The other bleach precursors studied were sodium benzoyloxybenzene-4-sulfonate (SBOBS), and sodium nonanoyloxybenzene-4-sulfonate (SNOBS).

Storaqe Stability Studies

Storage studies were run on detergent formulations prepared by mixing the adjuncts with detergent base powders and sodium perborate monohydrate (SPM). Typically, 1.5 gm of mixture was prepared in a plastic cup and placed open inside a constant temperature/humidity chamber. The detergent compositions were formulated so as to provide at 1.5 grams/liter total detergent dosage in a wash, $3.1 \times 10^{-4}$ moles/liter of bleach precursor and $9.4 \times 10^{-4}$ moles/liter of SPM. Because various precursor particulate additives contained differing levels of precursor, the level of particulate additive in the detergent formulations was adjusted accordingly. The chamber was adjusted to 80° F. and 70% relative humidity. Samples were left in open cups for one week and then removed for analysis. This was felt to be a reasonable open-cup storage period for a detergent powder, since it can correspond to a typical time between uses of the product by a consumer.

Evaluation of the products after the 1 week storage product was by either of two methods. In some cases, the samples were chemically analyzed for CSPC and its decomposition product, p-phenolsulfonate, by reverse phase HPLC. Stability was expressed as the percent of precursor decomposed, abbreviated herein as %D. It had been shown for a number of systems that the decomposition of CSPC attending the preparation of the particulate additives was inconsequential.

In other cases, the products were evaluated by measuring the bleaching of a standard tea test cloth. The test was based on experimental data indicating that SPM and other detergent components are stable under the storage conditions employed, and that the loss of bleaching can be ascribed to the loss of precursor.

Bleaching experiments were performed on a given product before and after the storage period. All bleaching experiments were performed in Terg-o-Tometers, at 40° C. with 120 ppm hardness water (Ca:Mg=2:1). Bleaching was tested on a standard tea-stained test cloth designated BC1. After washing the cloth for 15 minutes in the detergent/bleach precursor/SPM solution, the cloths were rinsed and dried and their reflectance measured as described below.

The results of the bleaching experiments were the changes in reflectance ($\Delta R$) of the BC1 cloths. The reflectance was measured on a Gardner tristimulus colorimeter and the measured values of $\Delta R$ corresponded to the change in the Y tristimulus value. Changes in $\Delta R$ are readily perceived as changes in the general whiteness of the cloth. In order to determine the bleaching effect of the precursor separately from that of the rest of the detergent formulation, the value of $\Delta\Delta R$, being the difference in $\Delta\Delta R$ values measured between systems containing or not containing the precursor but otherwise equivalent, was calculated. When a storage study was run, $\Delta\Delta R$ was measured on the freshly prepared detergent formulation and on the formulation stored under the specified storage condition. The relative loss in bleaching (LB), usually expressed as a percentage, was then defined as:

$$LB=(\Delta\Delta R_o-\Delta\Delta R_f)/\Delta\Delta R_o$$

where $\Delta\Delta R_o$ and $\Delta\Delta R_f$ are the measured $\Delta\Delta R$ values respectively prior to and after the storage period. Bleaching experiments were performed in Terg-o-Tometers at 40° C. in the presence of 120 ppm hard water (Ca:Mg=2:1).

A low value of either %D or %LB represents a stable product. Products which give %D or %LB values of 100% are completely unstable.

In all cases, the storage results reported herein were based on averaged results from duplicate samples.

It was found that for all of those systems where significant decomposition of CSPC occurred, the decomposition was accompanied by visible physical disintegration and discoloration of the particulate additives. This was seen in no cases for any of the other precursors studied. This serves to further distinguish CSPC with regard to its storage behavior from other bleach precursors mentioned in the known art. Since the decomposition was visibly obvious to a user of a product containing the unstable particulate additive, it was clearly important that maintaining a very high stability was particularly important when using CSPC as a bleach precursor.

Delivery Experiments

From a practical viewpoint, it is important that any useful particulate additive not only protect CSPC from decomposition, but also deliver all the CSPC present in the particulate additive to a wash liquor under realistic washing conditions. Since the precursor CSPC and particulate additives containing it were intended for use in domestic laundry operations, it was important that delivery be suitable under those conditions. Typically under domestic laundry conditions, the available wash time for dissolution of the particulate additives would be 15 minutes at water temperatures as low as 10° C. Thus, delivery of particulate additives was thus tested in Terg-o-Tometers in the presence of base powders and sodium perborate monohydrate under the same conditions as the bleach experiments described above, except that the temperature was set at 10° C. rather than 40° C. Small samples were taken of the wash liquor at various times, filtered, and analyzed by reverse phase HPLC. Systems were preferred if 90% of the CSPC present in the particulate adjunct dissolved within 15 minutes. The designation $t_{90}$ was used in the Tables for the time in minutes required for 90% dissolution. In all of a number of cases tested, delivery of CSPC was as fast or faster at 40° C. than at 10° C.

EXAMPLE 2

EFFECT OF VARIOUS PRECURSORS

The particulate additive compositions given in Experiments 1 to 3 in Table I were prepared as described above. The binder used in all cases was polyoxyethylene 21 stearyl ether, sold by ICI under the trademark Brij 721. Additives were mixed with appropriate amounts of base powder and SPM and their bleaching tested. Following one week of storage as described above, the bleaching was again measured. The results, expressed as %LB are given in Table I. They show that this binder system (Brij 721 alone), gave stable systems with the precursors SNOBS and SBOBS. However, CSPC was different in that this particulate additive although prepared with the same binder system was completely unstable.

TABLE I

| Experiment No. | Weight % in Particulate Additive: Brij 721 | Precursor | Type Precursor | % LB | % D |
|---|---|---|---|---|---|
| 1 | 21.0 | 79.0 | SNOBS | −8.3 | ND |
| 2 | 28.6 | 71.4 | SBOBS | ND | 0.0 |
| 3 | 28.5 | 71.5 | CSPC | 100.0 | 100.0 |

Notes
ND = Not Determined

EXAMPLE 3

EFFECT OF VARIOUS ETHOXYLATES

The particulate additives in Experiments 4 to 13 were prepared and their storage stability tested in a manner similar to that employed for Example 2. All of these particulate additives contained the precursor, and some ethoxylated material as all or part of the dispersing agent. In Experiments 5, 6, 8, 10 and 14, approximately half of the dispersing agent was substituted by the stabilizing agent, lauric acid. In Experiment 12, approximately half the dispersing agent was substituted by the stabilizing agent, palmitic acid. All of the dispersing agent materials tested were waxy solids melting at between 60° and 100° C. Following the end of the storage test, all the materials were assayed for CSPC remaining by high pressure liquid chromatography (HPLC), or the CSPC stability determined by bleaching experiments.

The compositions and results of the storage test are shown in Table II. These results demonstrate that the addition of lauric acid or palmitic acid to various ethoxylated binders causes a dramatic increase in CSPC stability. This is particularly seen to be the case for the experiments containing Brij 721 ® or 700 ® and Plurafac A38 ®, while the stable particulate additives containing Tergitol 15-S-20 ® as the sole binder were too soft to extrude effectively. Nevertheless, the combinations of the Tergitol 15-S-20 ® with lauric acid extruded well and gave a stable particulate additive.

TABLE II

| Experiment No. | Weight % in Particulate Additive: Main Dispersing Agent | Lauric Acid | Precursor (CSPC) | Main Dispersing Agent Type | % Decomposition |
|---|---|---|---|---|---|
| 4 | 19.5 | — | 80.5 | Brij 700 ® | 100.0 |
| 5 | 10.4 | 10.0 | 79.6 | Brij 700 ® | 2.9 |
| 3 | 28.5 | — | 71.5 | Brij 721 ® | 100.0 |
| 6 | 10.1 | 10.8 | 79.1 | Brij 721 ® | 2.7 |
| 7 | 28.6 | — | 71.4 | Plurafac A38 ® | 100.0 |
| 8 | 16.2 | 16.2 | 67.6 | Plurafac A38 ® | 3.0 |
| 9 | 28.6 | — | 71.4 | Pluronic F38 ® | 100.0 |
| 10 | 10.1 | 10.9 | 79.0 | Pluronic F38 ® | 5.0 |
| 11 | 20.7 | — | 79.3 | PEG 1000 ® | 98.4 |
| 12 | 10.2 | 10.9 | 78.9 | PEG 1000 ® | 66.1 |
| 13 | 11.0 | 20.0 | 79.0 | PEG 1000 ® | 22.4 |
| 14 | 14.3 | 14.3 | 71.5 | Tergitol 15-S-20 ® | 3.3 |

EXAMPLE 4

EFFECT OF VARIOUS ACIDS

Experiments 15–20 were prepared and tested to show that lauric acid is not uniquely suited to the purposes of this invention, and that in fact it is not necessary to use a fatty acid. The results are given in Table III. Thus, while lauric and palmitic acids, both being waxy solids melting between 40 and 100° C., might themselves assist in dispersing the particle as well as being acidic components, the same cannot be said of the other acids reported in Table III (potassium bisulfate, oxydisuccinic acid, succinic acid, and citric acid). For this reason, the level of Brij 721® was approximately doubled in the particulate additives of Experiments 16–20, so that the total dispersing agent level was about the same as for the particulate additives containing lauric and palmitic acid. For extrudability, it was found that noodle-like particulate additives must contain at least about 20% by weight of dispersing agent. This may not be a requirement for particulate additives made by some other process such as pan granulation.

Palmitic acid and oxydisuccinic acid are seen from Table III to confer great stability to the particulate additives. Although the particulate additive containing the other acids were not evaluated for %D (decomposition), most of the bleaching was still recovered at the end of the storage study. Thus, even such acids as citric, malic and succinic perform effectively as stabilizers for CSPC, although perhaps not as preferred as the fatty acids.

TABLE III

| Experiment No. | Weight % in Particulate Additives: Brij 721® | Acid | Precursor | Acid Type | % D | % LB |
|---|---|---|---|---|---|---|
| 15 | 10.2 | 10.8 | 79.0 | Palmitic | 2.5 | ND |
| 16 | 20.6 | 10.9 | 68.5 | oxydi-succinic | 3.1 | ND |
| 17 | 21.0 | 10.0 | 69.0 | Citric | ND | 18.1 |
| 18 | 21.0 | 10.0 | | Malic | ND | 11.1 |
| 19 | 21.0 | 10.0 | | Succinic | ND | 10.8 |
| 20 | 21.0 | 10.0 | (a) | Potassium Bisulfate | ND | 2.7 |

Notes
ND = Not Determined
(a) CSPC was here used in purified form not containing any sodium chloride.

EXAMPLE 5

EFFECT OF DIFFERENT LAURIC ACID LEVELS

The earlier Examples demonstrated that acid served to stabilize CSPC particulate additives in combination with a number of ethoxylates. Experiments 21–29 were prepared to determine what minimum level of acid was required to stabilize CSPC. The results are shown in Table IV.

TABLE IV

| Experiment No. | Level in Particulate Additive (wt. %): Prec | Brij 721® | Acid | % D | % LB | $t_{90}$ (min) |
|---|---|---|---|---|---|---|
| 21 | 79.0 | 0.0 | 21.0% lauric | ND | −1.2 | 28.8 |
| 22 | 79.0 | 3.2 | 17.8% lauric | ND | 7.3 | 16.1 |
| 23 | 78.9 | 7.4 | 13.9% lauric | ND | 23.7 | 12.8 |
| 24 | 79.1 | 10.1 | 10.8% lauric | 2.7 | 10.5 | 10.0 |
| 25 | 78.9 | 14.0 | 7.1% lauric | ND | 6.5 | 3.4 |
| 26 | 79.0 | 16.8 | 4.2% lauric | ND | 62.9 | 4.4 |
| 27 | 79.0 | 21.0 | None | ND | 106 | 5.6 |
| 28 | 76.6 | 20.6 | 2.8% oxydi-succinic | 100.0 | ND | ND |
| 29 | 75.9 | 20.6 | 3.5% citric | 100.0 | ND | ND |

Notes
ND = Not Determined

Experiments 21–26 illustrate systems containing lauric acid. While 4.2% by weight of lauric acid (Experiment 26) results in essentially unstable particulate additives, 7% lauric acid (Experiment 25) provided a reasonable level of stability. Similar Experiments 28 and 29 show that less than about 5 % by weight of oxydisuccinic or citric acid is insufficient to confer stability to SCPS particulate additives.

Experiment 21 is of an additive prepared with lauric acid as the sole dispersing agent. This additive was stable so that the presence of the ethoxylate dispersing agent may not be necessary for stability purposes. However, the delivery data, also shown in Table IV indicates that at least 3% by weight of the water soluble ethoxylate was needed to obtain adequate delivery of CSPC ($t_{90}$ within about 15 minutes) at 10° C. Thus, systems containing at least a small amount of water soluble dispersing agent are clearly preferred over those which are bound only with a water insoluble acidic agent such as lauric acid.

The foregoing description and examples illustrate selected embodiments of the present invention. In light thereof, various modifications will be suggested to one skilled in the art, all of which are within the spirit and purview of this invention.

What is claimed is:

1. A particulate detergent composition additive, each particle being an intimately blended mixture comprising:

(i) from 30 to 95% of a precursor compound having the formula:

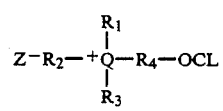

(I)

wherein:

$R_1$, $R_2$ and $R_3$ are each a radical selected from the group consisting of alkyl, alkenyl, alkynyl, cycloalkyl, cycloalkenyl, alkaryl, aryl, phenyl, hydroxyalkyl, polyoxyalkylene, and $R_4OCOL$;

or two or more of $R_1$, $R_2$, and $R_3$ together form an alkylsubstituted or unsubstituted nitrogen-containing heterocyclic ring system;

or at least one of $R_1$, $R_2$, and $R_3$ is attached to $R_4$ to form an alkyl substituted or unsubstituted nitrogen-containing heterocyclic ring system;

$R_4$ is selected from a bridging group consisting of alkylene, cycloalkylene, alkylenephenylene, phenylene, arylene, and polyalkoxylene; and wherein the bridging group can be unsubstituted or substituted with $C_1$–$C_{20}$ atoms selected from alkyl, alkenyl, benzyl, phenyl and aryl radicals;

$Z^-$ is a monovalent or multivalent anion leading to charge neutrality when combined with $Q^+$ in the appropriate ratio and wherein $Z^-$ is sufficiently oxidatively stable not to interfere significantly with bleaching by a peroxy carbonic acid;

Q is nitrogen or phosphorous; and

L is selected from the group consisting of

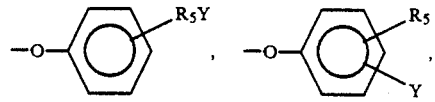

-continued

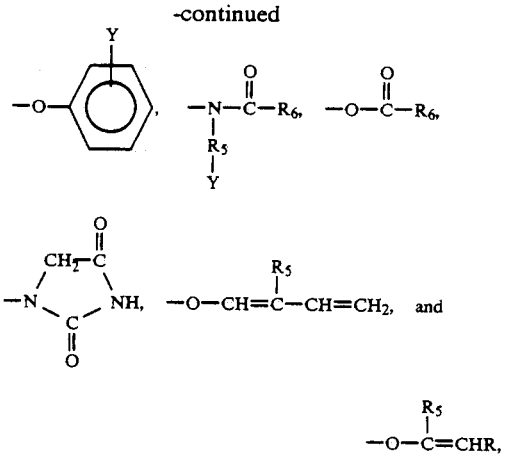

wherein $R_5$ and $R_6$ are a $C_1$–$C_{12}$ alkyl group, $R_7$ is H or $R_5$, and Y is selected from the group consisting of H, —SO M , —COO M , —SO M , $—N^+(R_5)_3X^-$, $NO_2$, OH, and O $\leftarrow N(R_5)_2$ and mixtures thereof; $M^+$is a cation which provides solubility to the precursor, and $X^-$is an anion which provides solubility to the precursor;

(II) a stabilizing agent for said precursor present in an effective amount to restrain hydrolysis, said stabilizing agent being selected from the group consisting of solid inorganic acids and $C_4$ or higher organic acids having at least one carboxylic group; and (iii) a dispersing agent which is a water-soluble alkoxylated material having about 10 to 100 moles of alkoxide per mole hydrophobe present in an effective amount to promote dispersion of the particulate in an aqueous medium, said agent being selected from the group consisting of alkoxylated fatty alcohols, alkoxylated fatty acids, alkoxylated alkylphenols, polypropoxylated-polyethoxylated copolymers and mixtures thereof, the ratio of stabilizing agent to dispersing agent ranging from about 5:1 to 1:5.

2. A particulate additive according to claim 1 wherein the stabilizing agent is selected from the group consisting of $C_4$–$C_{22}$ monocarboxylic acids, $C_4$–$C_{22}$ dicarboxylic acids, $C_4$–$C_{22}$ tri- or higher polycarboxylic acids, and mixtures thereof.

3. A particulate additive according to claim 1 wherein the stabilizing agent is present in amounts from 5% up to 50%.

4. A particulate additive according to claim 3 wherein the stabilizing agent is selected from the group consisting of lauric, myristic, palmitic, stearic and isostearic acids.

5. A particulate additive according to claim 2 wherein the stabilizing agent is selected from the group consisting of polyacrylic acid, polymethacrylic acid and polyacrylic/maleic acid polymers.

6. A particulate additive according to claim 2 wherein the stabilizing agent is a dicarboxylic or tricarboxylic acid selected from the group consisting of phthalic, terephthalic, isophthalic, tartaric, citric, carboxymethyloxy succinic, fumaric, maleic, malic, adipic, succinic, oxydisuccinic, dodecanedioic acids and mixtures thereof.

7. A particulate additive according to claim 2 wherein the stabilizing agent is a monocarboxylic acid selected from the group consisting of benzoic, benzylic, ethylhexanoic, n-octanoic acids and mixtures thereof.

8. A particulate additive according to claim 1 wherein the stabilizing agent is potassium bisulfate.

9. A particulate additive according to claim 1 wherein the dispersing agent is selected from the group consisting of alkoxylated $C_{10}$–$C_{22}$ fatty alcohols, alkoxylated $C_{10}$–$C_{22}$ fatty acids, alkoxylated $C_6$–$C_{22}$ alkyl phenols, polypropoxylated-polyethoxylated copolymers, and mixtures thereof.

10. A particulate additive according to claim 1 wherein the dispersing agent is present in an amount from about 5% to about 50% by weight.

11. A particulate additive according to claim 1 wherein the dispersing agent is present in an amount from about 10% to about 20% by weight.

12. A particulate additive according to claim 1 wherein the dispersing agent is a polyoxyethylene stearyl ether.

13. A particulate additive according to claim 1 wherein the precursor is defined by $M^+$being hydrogen, alkali metal, ammonium or alkyl or hydroxyalkyl substituted ammonium cation, and $X^-$being a halide, hydroxide, phosphate, sulfate, methyl sulfate or acetate anion.

14. A particulate additive according to claim 1 wherein L has the formula

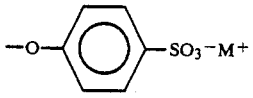

wherein $M^+$is a sodium, potassium or ammonium cation.

15. A particulate additive according to claim 1 ,wherein Q is nitrogen and $R_1$, $R_2$ and $R_3$ are each the same or different and selected from $C_1$–$C_{20}$ atom radicals selected from the group consisting of alkyl, alkylaryl, benzyl, hydroxyalkyl, and heterocyclic rings containing the quaternary nitrogen where R and $R_4$ or $R_1$ and $R_2$ are joined together, and mixtures of groups thereof.

16. A particulate additive according to claim 1 wherein the precursor is 2-(N,N,N-trimethylammonium)ethyl 4-sulfophenyl carbonate salt.

17. A bleaching-detergent composition comprising:

(i) from 1 to 60% of a peroxygen compound capable of yielding hydrogen peroxide in an aqueous solution;

(ii) from 0.1 to 40% of the particulate additive of claim 1;

(iii) from 0 to 50% of a surfactant; and (iv) from 0 to 70% of a detergent builder.

18. A bleaching-detergent composition according to claim 17 wherein the precursor is 2-(N,N,N-trimethylammonium)ethyl 4-sulfophenyl carbonate salt.

* * * * *